US010968578B2

(12) United States Patent
Veneri

(10) Patent No.: US 10,968,578 B2
(45) Date of Patent: Apr. 6, 2021

(54) HIGH EXCURSION EXPANSION JOINT

(71) Applicant: UNIVERGOM S.r.l., San Giorgio Bigarello (IT)

(72) Inventor: Gianantonio Veneri, Porto Mantovano (IT)

(73) Assignee: UNIVERGOM S.R.L., San Giorgio Bigarello (IT)

( * ) Notice: Subject to any disclaimer, the term of this patent is extended or adjusted under 35 U.S.C. 154(b) by 33 days.

(21) Appl. No.: 16/527,811

(22) Filed: Jul. 31, 2019

(65) Prior Publication Data

US 2020/0040535 A1 Feb. 6, 2020

(30) Foreign Application Priority Data

Aug. 3, 2018 (IT) ..... 102018000007848

(51) Int. Cl.

| | |
|---|---|
| ***E01C 11/00*** | (2006.01) |
| ***E01D 19/10*** | (2006.01) |
| ***E01D 22/00*** | (2006.01) |
| ***E01B 11/42*** | (2006.01) |
| ***E01C 11/02*** | (2006.01) |

(52) U.S. Cl.

CPC ..... *E01D 19/106* (2013.01); *E01B 11/42* (2013.01); *E01C 11/005* (2013.01); *E01C 11/02* (2013.01); *E01D 22/00* (2013.01)

(58) Field of Classification Search

CPC ..... E01B 11/42; E01C 11/005; E01C 11/02; E01D 19/06; E01D 22/00

USPC ..... 404/47–72; 52/396.02–396.05

See application file for complete search history.

(56) References Cited

U.S. PATENT DOCUMENTS

| | | | | |
|---|---|---|---|---|
| 3,387,544 A | | 6/1968 | MacLellan | |
| 3,797,188 A | * | 3/1974 | Mansfeld | E01D 19/06 52/396.05 |
| 4,184,298 A | * | 1/1980 | Balzer | E01C 11/126 14/73.1 |
| 4,885,885 A | * | 12/1989 | Gottschling | E04B 1/6804 52/396.05 |
| 5,060,439 A | * | 10/1991 | Clements | E04B 1/6815 52/396.07 |
| 5,297,372 A | * | 3/1994 | Nicholas | E04B 1/6804 52/396.05 |
| 5,384,996 A | * | 1/1995 | Nicholas | E04B 1/681 404/57 |

(Continued)

FOREIGN PATENT DOCUMENTS

| | | |
|---|---|---|
| EP | 1975330 A2 | 10/2008 |
| FR | 2009752 A1 | 2/1970 |

OTHER PUBLICATIONS

Search Report for Corresponding Italian Application No. 201800007848 (7 Pages) (dated Mar. 21, 2019).

*Primary Examiner* — Raymond W Addie

(74) *Attorney, Agent, or Firm* — Lucas & Mercanti, LLP

(57) ABSTRACT

An expansion joint connects structural elements of a building structure to fill a space between the structural elements themselves. The expansion joint has a plate body and a deformable body flanked or adjacent to the plate body along the longitudinal direction. The deformable body includes two superimposed and structurally independent portions connected to each other in a removable way, or configured for a removable connection with one another.

21 Claims, 4 Drawing Sheets

(56) References Cited

U.S. PATENT DOCUMENTS

| | | | | |
|---|---|---|---|---|
| 6,499,265 | B2 * | 12/2002 | Shreiner | E01D 19/06 404/68 |
| 6,581,347 | B1 * | 6/2003 | Knak | E04B 1/6815 404/58 |
| 7,252,454 | B2 * | 8/2007 | Bradford | E01D 19/062 14/73.1 |
| 7,827,750 | B2 * | 11/2010 | Sondermann | E04F 19/061 52/396.04 |
| 8,887,463 | B2 * | 11/2014 | Derrigan | E02D 17/10 52/395 |
| 8,959,860 | B2 * | 2/2015 | Wierzbowski | E04B 1/681 52/396.05 |
| 9,670,663 | B2 * | 6/2017 | Bradford | E04B 1/68 |
| 9,689,157 | B1 * | 6/2017 | Hensley | E04B 1/6803 |
| 9,689,158 | B1 * | 6/2017 | Hensley | E04B 1/68 |
| 2008/0196183 | A1 * | 8/2008 | Xu | E01D 19/06 14/73.1 |
| 2018/0112363 | A1 * | 4/2018 | Bradford | E04B 1/681 |
| 2018/0209104 | A1 * | 7/2018 | Bang | E01D 19/06 |
| 2019/0085555 | A1 * | 3/2019 | Moore | E04B 1/6812 |
| 2020/0002906 | A1 * | 1/2020 | Moore | E01D 19/065 |
| 2020/0157752 | A1 * | 5/2020 | Braun | E01C 11/08 |
| 2020/0270828 | A1 * | 8/2020 | Rill | E01D 19/062 |

* cited by examiner

HIGH EXCURSION EXPANSION JOINT

CROSS-REFERENCE TO RELATED APPLICATIONS

This application claims the benefit of Italian Patent Application No. 102018000007848, filed Aug. 3, 2018, the contents of which are incorporated herein by reference.

FIELD OF INVENTION

The present disclosure generally relates to an expansion joint for building constructions, also called a structural joint. More particularly, the present disclosure relates to an expansion joint designed to fill a space in building structures and configured to absorb the deformations of such structures, after changes in the ambient temperatures or after seismic events.

BACKGROUND OF THE INVENTION

In many structures, joints are used to accommodate the relative movements of the individual structural elements of the structure without sacrificing the indispensable structural continuity of a roadway. More specifically, the expansion joints allow the free expansion or contraction of parts of a structure following seasonal or daily thermal excursion phenomena.

A typical example of such joints are the expansion joints used in building structures, for example in buildings such as roads, bridges or viaducts or in the railway field. In the case of roads, for example, a space is generally left between two road decks, so that they are free to expand or contract depending on the ambient temperature. These spaces are filled by expansion joints that ensure the continuity of the road pavement while allowing relative movement of the road decks.

There are different types of expansion joints on the market, classified according to their structure and to the materials of which they are made.

Among the different types of expansion joints, we can distinguish reinforced rubber joints, generally characterized by relatively low costs and by the fact that they allow large excursions as well as easy placement.

Historically, such joints are mainly used in the road field in order to connect two road decks in the longitudinal direction and comprise a more or less numerous series of openings, generally perpendicular to the longitudinal direction of the joint itself, necessary for the development of the required elastic deformations. Such joints are in fact traditionally constituted by an elastic structure in which, by means of a vulcanization process or other technological process, metal profiles are inserted which are adapted to modify, at certain points, the rigidity or load-bearing capacity of the elastic structure itself.

More specifically, the rubber expansion joints generally comprise a plate element arranged between the structural elements among which the joint is placed, for example, in the case of a road or a bridge, between two road decks. These joints also comprise at least one deformable body able to absorb the deformations of at least one of the elements of the structure itself.

In addition, in general, in order to ensure the continuity of the pavement and to protect the substructure from the rainwater, the entire joint is covered with elastic material.

The presence of this elastic covering material is however a drawback of the joints of the prior art, firstly because, mainly by cause of the passage of the vehicles in the case of road joints, and in general due to the wear caused, for example, by the agents atmospheric, the elastic material tends to wear down. In particular, the wear of the elastic material can compromise the structure and the functionality of the joint.

Secondly, any damage to the elastic material compromises the impermeability of the joint. In fact, cracks or discontinuities in the rubber of which the joint is made could lead to the infiltration of rainwater.

Consequently, in case of wear or damage, maintenance or replacement of expansion joints is often necessary. Such maintenance interventions, especially due to the conformation of known joints, are very complex and expensive and often require the replacement of the entire joint.

SUMMARY OF THE INVENTION

The present disclosure proposes to provide an expansion joint which allows to overcome the aforementioned drawbacks with reference to the prior art and/or to achieve further advantages.

This is achieved by providing an expansion joint and a method for repairing an expansion joint according to the respective independent claims.

Particular embodiments of the subject of the present disclosure are defined in the corresponding dependent claims.

The present disclosure starts from the recognition of the author of the present disclosure, that the conformation of the expansion joints belonging to the prior art makes maintenance due to wear, in particular the wear of the elastic components, particularly difficult.

Specifically, any damage to the elastic components of the expansion joints according to the prior art often requires the replacement of the entire joint, or of the entire module of the joint in which the damaged element is present.

It follows that, in addition to the high timing and complexity of maintenance operations, the joints belonging to the prior art are characterized by high management costs.

In one embodiment, the expansion joint according to the present disclosure comprises a plate element adapted to be interposed between the structural elements of a building structure and at least one deformable body able to connect this plate element with at least one of said structural elements along a longitudinal direction. In other words, the joint connects to one or more structural elements to form a structure that develops and extends in a certain direction, which is defined as the longitudinal direction. This deformable body further comprises an upper portion and a lower portion which can be removably connected, wherein said upper and lower portions respectively comprise a plurality of first transversal elements connected with each other by elastic portions, preferably arranged alongside two by two in the longitudinal direction and of second transversal elements connected to each other, preferably alongside two by two in the longitudinal direction by means of elastic elements. The transversal elements extend in a transversal direction, preferably orthogonal, with respect to the longitudinal direction.

The transversal elements of the first portion form, for example, a walkable surface or a carriageable surface of the joint. In other words, it is a visible and/or exposed surface.

Preferably the first elastic portions and the second elastic portions are hidden with respect to the exposed surfaces of the joint, respectively the upper visible surface and the lower visible surface.

It follows that, according to an embodiment of the present disclosure, the replacement of the components of the joint, in particular of the elastic elements, as a result of wear, is facilitated and the maintenance operations are simplified and speeded up.

With the expansion joint object of the present disclosure it is then possible to avoid the replacement of the entire joint in case of damage to one of its components, being able to intervene directly only on the damaged portion.

It follows that the expansion joint according to the present disclosure also produces an economic advantage, due to the low intervention and maintenance costs.

Moreover, given the always lower points wherein the joints are provided, these latter must allow for ever-greater sliding. Consequently, in an embodiment of the present disclosure, the expansion joint can comprise a number of elastic elements variable according to the excursion required.

According to an embodiment of the present disclosure, the expansion joint comprises interlocking profiles suitable for connection with other joints, so that said expansion joint is able to connect together structural elements of different sizes.

Finally, unlike many prior art joints, the expansion joint according to the present disclosure does not require the presence of anti-lifting bars.

Further advantages, features and methods of use of the object of the present disclosure will be apparent from the following detailed description of its embodiments, presented by way of example and not of limitation.

It is however evident that each embodiment of the object of the present disclosure may present one or more of the advantages listed above; in any case it is not required that each embodiment present simultaneously all the advantages listed.

DESCRIPTION OF THE FIGURES

Reference will be made to the figures of the accompanying drawings, wherein.

DETAILED DESCRIPTION OF THE INVENTION

Figure 1:
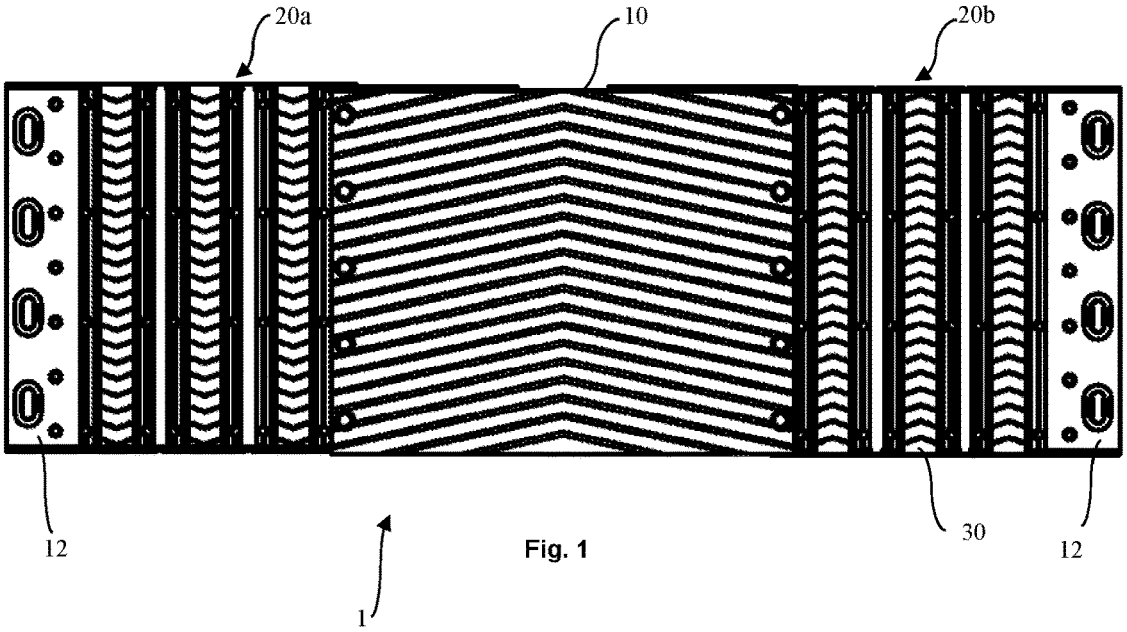
FIG. 1 represents a top view of an expansion joint according to the present disclosure.
Figure 2:
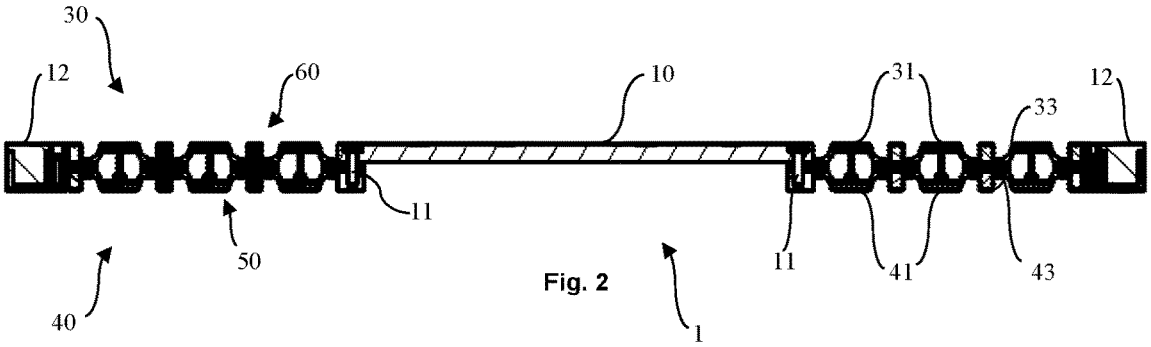
FIG. 2 represents a side view of an expansion joint according to the present disclosure.

With reference to the attached figures, an embodiment of an expansion joint is indicated with the reference number 1.

The term "expansion joint" refers to an element in the present disclosure which is able to connect at least partially structural elements of the same structure in a longitudinal direction and to allow relative movements between the structural elements themselves. Preferably, the expansion joint 1 according to the present disclosure is able to connect together road decks in structures such as bridges or viaducts.

Moreover, with the term "transversal" in the context of the present disclosure it is meant a direction of development that intersects or crosses the longitudinal direction.

It can be understood that the expansion joint is arranged substantially horizontally in an intermediate position between the decks. In the context of the present disclosure, any spatial reference, such as upper, lower, above, below, or similar reference must be understood in a non-limiting manner with reference to a horizontal position of the joint.

In particular, with reference to FIGS. 1 to 4, the expansion joint 1 according to the present disclosure comprises a plate body 10 able to fill a space between the structural elements to be connected. For example, this plate body 10 is able to fill a gap between two roadway decks of a bridge or a viaduct in such a way as to ensure the continuity of the road pavement while allowing the free expansion or contraction of the decks themselves depending on the ambient temperature, or in case of other stresses. The plate body 10 is preferably metal, even more preferably steel. Moreover, the plate body 10 is preferably coated with elastic material, preferably rubber, so as to ensure protection from rainwater. Preferably, the plate body 10 can be coated in an elastic material or treated with an anticorrosive protection, for example with a two-component epoxy coating. Preferably, moreover, the driveway surface of the joint, in particular the driveway surface of the plate body 10, can be treated with a zinc primer and an antiskid epoxy coating.

The expansion joint 1 further comprises at least one deformable body 20. This at least one deformable body 20 is able to connect in a longitudinal direction the plate body 10 with a structural element of the structure on which the joint 1 is able to be installed. Specifically, the deformable body 20 is interposed between the plate body 10 and a structural element in such a way as to allow the latter free expansion and contraction.

In other words, the deformable body 20, the plate body 10, and the structural element form, in that order, a flanking or a sequence of elements in the longitudinal direction.

According to one aspect of the present disclosure, the at least one deformable body 20 comprises two structurally separable pieces, that is to say two portions superimposed on each other to form a two-layer or multilayer structure. Specifically, it consists of an upper portion 30 and a lower portion 40 which can be removably connected. In other words, the at least one deformable body 20 includes an upper portion 30 designed to ensure the structural continuity between the plate body 10 and the structural element to which the latter is connected, and a lower portion 40 suitable for the support of the upper portion 30. In this way, the upper portion 30, which is more exposed to wear as it is for example exposed to atmospheric agents and, in the case of a road joint, in contact with the tires of the vehicles, can be easily separated from the lower portion 40 and replaced. It follows that in the event of wear of one or more of the components of the upper portion 30, the maintenance operations are simplified and speeded up and the replacement of the entire expansion joint 1 is not required. Furthermore, also the replacement of the entire deformable body 20 is an easy operation, since it is connected to the plate body 10 and to a structural element by means of common connection means such as screws or anchor bolts.

In other words, it is a joint in which the deformable body is formed by two components superimposed and connected to each other in a removable manner.

According to one embodiment, the connection between the upper portion 30 and the lower portion 40 can be made by means of interlocking elements 60. Alternatively and/or in addition to these interlocking elements 60, the expansion joint according to the present disclosure can comprise fixing means, such as screws, between the upper portion 30 and the lower portion 40 of the at least one deformable body 20.

In order to confer deformability to the joint, the upper portion 30 and the lower portion 40 each comprise a plurality of substantially flat supporting portions for the vehicles that pass on the road surface and/or support portions of the expansion joint 1 to an underlying structure and portions of mutual contact. The support portions are aligned opposite and spaced apart from each other. Between the flat supporting portions and the mutual contact portions are included elastic portions that allow a sort of springing of the entire joint. In other words, said elastic parts allow expansion of the joint due, for example, to changes in the ambient temperature or to seismic events. The support portions and the elastic parts are arranged so as to form, in section, at least one ring structure or configuration 50.

Depending on the deformability that the joint must be able to reach, there may be more than one ring structure 50 connected to each other through the portions of mutual contact.

In particular, the upper portion 30 comprises a plurality of first transversal elements 31, that is to say, elements with a main development direction perpendicular to the longitudinal direction of connection between the structural elements that the expansion joint 1 is able to connect, connected in the longitudinal direction by first elastic portions 32, or similar elements having a greater deformability than the first transversal elements 31. These first transversal elements can be metallic elements, such as for example metal plates.

The upper portion 30 also comprises a plurality of first plate-like elements 33, which represent the mutual contact elements mentioned above. The first plate-like elements 33 alternate with the first transversal elements 31 to form the body of the upper portion 30. In other words, said first transversal elements 31 and first plate-like elements 33 develop parallel to the plate body 10, in the transversal direction of the joint of expansion 1. This plurality of first transversal elements 31 can be metallic elements, such as for example metal plates. More specifically, said plurality of first transversal elements 31 of the upper portion 30 of the deformable body 20 comprises T-shaped elements 31*a*, connected and alternated in longitudinal direction to said first plate-like elements 33. In particular, said T-shaped elements 31*a* comprise a horizontal portion designed to guarantee the continuity surface of the joint 1 and suitable, for example to the contact with the vehicles in transit, and a vertical portion able to support said horizontal portion, while the first plate-like elements 33 are suitable for interlocking with the lower portion 40, for example through interlocking elements 60. According to an embodiment of the joint 1 according to the present disclosure, said first plate-like elements 33 comprise female portions 61 of interlocking elements 60.

Figure 6:
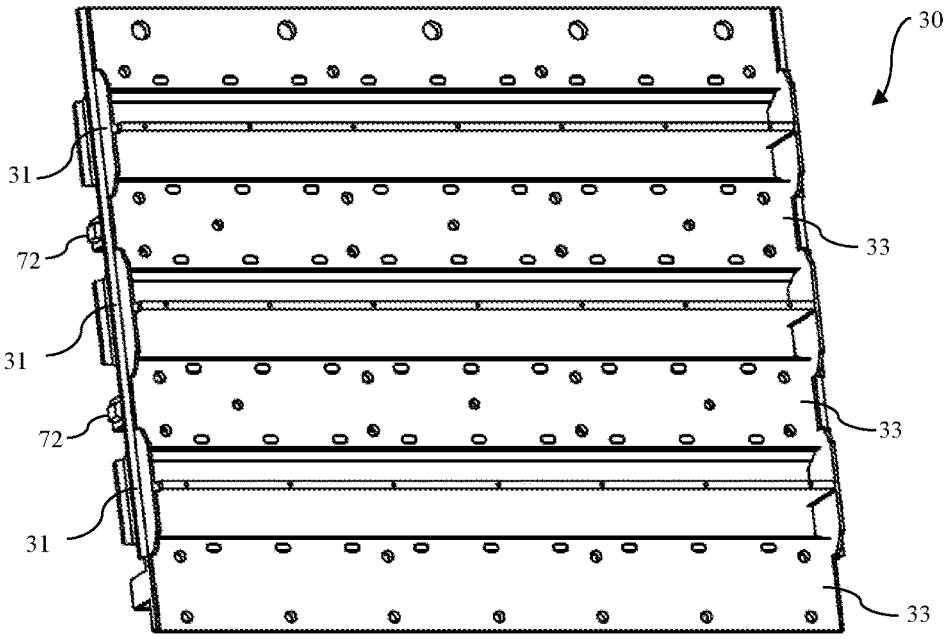
FIG. 6 shows a perspective view of an upper portion of the deformable body of an expansion joint according to the present disclosure.
Figure 7:
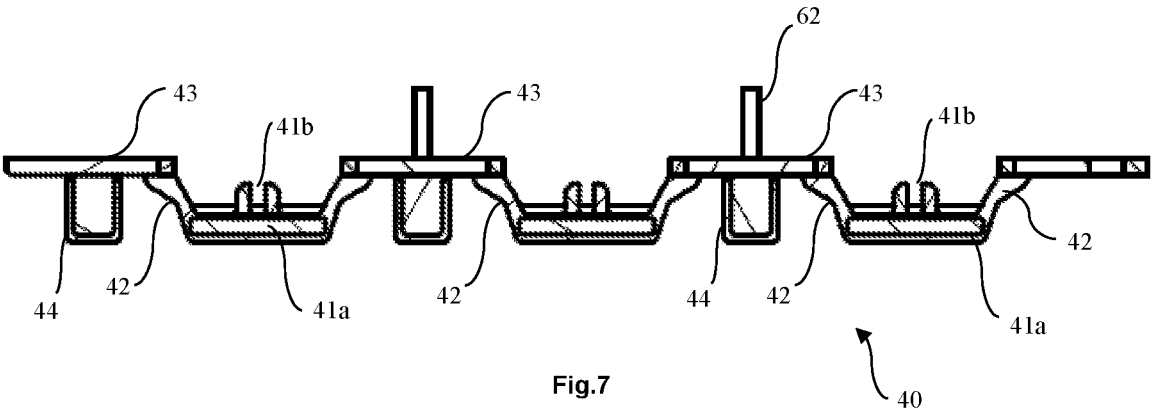
FIG. 7 shows a section view of a lower portion of the deformable body of an expansion joint according to the present disclosure.

Still more particularly, as mentioned above, said T-shaped elements 31*a* and said first plate-like elements 33 are connected to each other by means of first elastic portions 32 able to allow relative movements between the aforesaid first transversal elements. Preferably, said first elastic portions 32 are reinforced rubber elements, even more preferably elements composed of a natural rubber (NR) or chloroprene rubber (CR). Moreover, preferably, the aforementioned first transversal elements, specifically the T-shaped elements 31*a* and the first plate-like elements 33, are inserted inside the first elastic portions 32, for example through a vulcanization process. In this way the upper portion 30 is constituted by a single element, favoring the resistance of the entire joint. Moreover, the vulcanization of said first transversal elements within the first elastic portions 32 allows protection against wear due to contact with atmospheric agents and/or with vehicle tires. Moreover, as can be seen from FIG. 6, the upper portion 30 preferably comprises elements such as, for example, holes suitable for the passage of the fixing means for the connection of said upper portion 30 to the lower portion 40 and/or to the plate body 10.

Similar to the upper portion 30, the lower portion 40 comprises a plurality of second transversal elements 41, i.e. elements with a main development direction perpendicular to the longitudinal direction of connection between the structural elements which the expansion joint 1 is able to connect and which, consequently, develop parallel to the plate body 10, connected to each other in the longitudinal direction by means of second elastic portions 42, or similar elements having a greater deformability than the second transversal elements 41. In practice, the elastic portions 32, 42 or elements having greater deformability are elements able to allow relative movements between said first transversal elements 31 and between second transversal elements 41. Consequently, the at least one deformable body 20 can deform according to the expansion or contraction of the structural elements of the structure on which the joint of expansion 1 is apt to be installed. In particular, the structure of the at least one deformable body 20 allows both longitudinal and transversal movements between the structural elements, combinations of said two movements, and relative rotations on the plane of the expansion joint 1. Furthermore, the at least one deformable body 20 allows displacements of the structural elements also in the vertical plane, i.e. in a plane perpendicular to said longitudinal direction, an effect caused by the so-called pitching of the spans. According to an aspect of the present disclosure, the number of said first and second transversal elements 31, 41 is variable according to the maximum excursion required by the structure on which the expansion joint 1 is able to be installed. Preferably, however, the number of said first transversal elements 31 is equal to the number of said second transversal elements 41.

More specifically, said plurality of second transversal elements 41, which may be metal elements such as for example metal plates, comprises coupling elements 41*a* with the T-shaped elements 31*a*, connected and alternated in the longitudinal direction to second plate-like elements 43. The latter, together with the first plate-like elements 33, represent the mutual contact elements mentioned above. In particular, the coupling elements 41*a* provide a structural support to the T-shaped elements 31*a* allowing the expansion joint 1 to support the weight of the vehicles passing on it. Preferably, said coupling elements 41*a* are metal plate elements. Even more preferably, the coupling elements 41*a* comprise a coupling seat 41*b* for said T-shaped elements 31*a* able to increase the stability of the T-shaped elements 31*a* during movements. Said coupling seat 41*b* is preferably defined by two plate elements which extend in the transversal direction along the entire length of the coupling elements 41*a*. Specifically, the vertical portion of the T-shaped elements 31*a* is at least partially interposed between said two plate elements of the coupling element 41*a*. This configuration makes it possible that to movements of the upper portion 30 correspond with equivalent movements of the lower portion 40 and vice versa, in particular between the T-shaped elements 31*a* and the coupling elements 41*a*.

Alternatively, according to a further aspect of the present disclosure, the T-shaped elements can be placed on the lower portion 40 of the deformable body 20. In this case, the plurality of first transversal elements 31 of the upper portion 30 comprises coupling elements which are alternate in longitudinal direction with first plate-like elements 33, and the second transversal elements 41 of the lower portion 40 comprise T-shaped elements which are alternated in longitudinal direction with second plate-like elements. In other words, according to this aspect, the plurality of second transversal elements 41 of the lower portion 40 comprises T-shaped elements and the plurality of first transversal elements 31 of the upper portion 30 comprises coupling elements for a coupling with said elements shaped as "T".

The second plate-like elements 43 can comprise male portions 62 of interlocking elements 60 for connecting the upper portion 30 to the lower portion 40. Alternatively, the first plate-like elements 33 can comprise male portions 62 of interlocking elements 60 and the second plate-like elements 43 can comprising female portions of interlocking elements 60. These interlocking elements 60 help to ensure that the elements of the upper portion 30 of the deformable body 20 undergo displacements equivalent to the corresponding elements of the lower portion 40 to which they are connected following the expansion or of the contraction of the structural elements of the structure on which the joint is able to be installed. Moreover, said second plate-like elements 43 preferably comprise supporting elements 44 suitable for providing further structural support to the expansion joint 1 when the vehicles pass. More specifically, said support elements 44 provide support for the first and second plate-like elements 33, 43 and to the female portions 61 of the interlocking elements 60 which, in the case of road joints, are in direct contact with the vehicles in transit.

Figure 8:
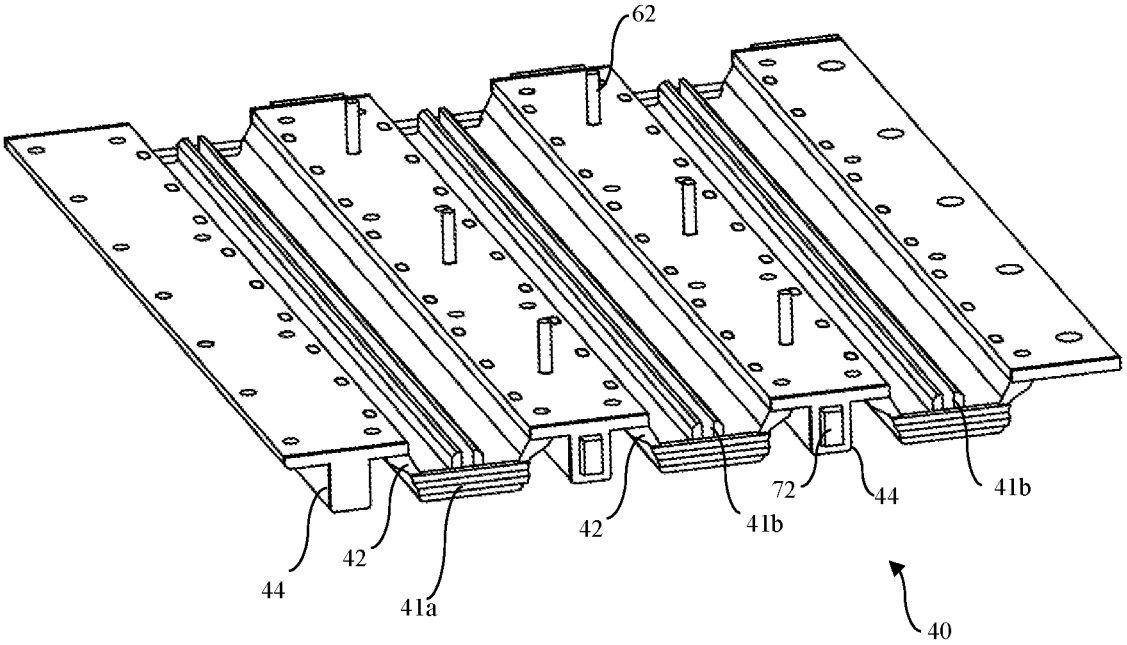
FIG. 8 shows a perspective view of a lower portion of the deformable body of an expansion joint according to the present disclosure.

As for the first transversal elements of the upper portion 30, the coupling elements 41*a* and the second plate-like elements 43 are connected to each other by means of second elastic portions 42 designed to allow relative movements between the aforesaid first transversal elements. Preferably, said second elastic portions 42 are reinforced rubber elements, even more preferably elements composed of a natural rubber (NR) or chloroprene rubber (CR). Moreover, preferably, the aforementioned second transversal elements 41, specifically the coupling elements 41*a* and the second plate-like elements 43, are inserted inside the second elastic portions 42, for example through a vulcanization process. In this way the upper portion 30 is constituted by a single element, favoring the resistance of the entire joint. Moreover, as can be seen from FIG. 8, the lower portion 40 preferably comprises elements such as for example holes suitable for passing the fixing means for connection between said lower portion 40 to the upper portion 30 and/or to the plate body 10.

Figure 9:
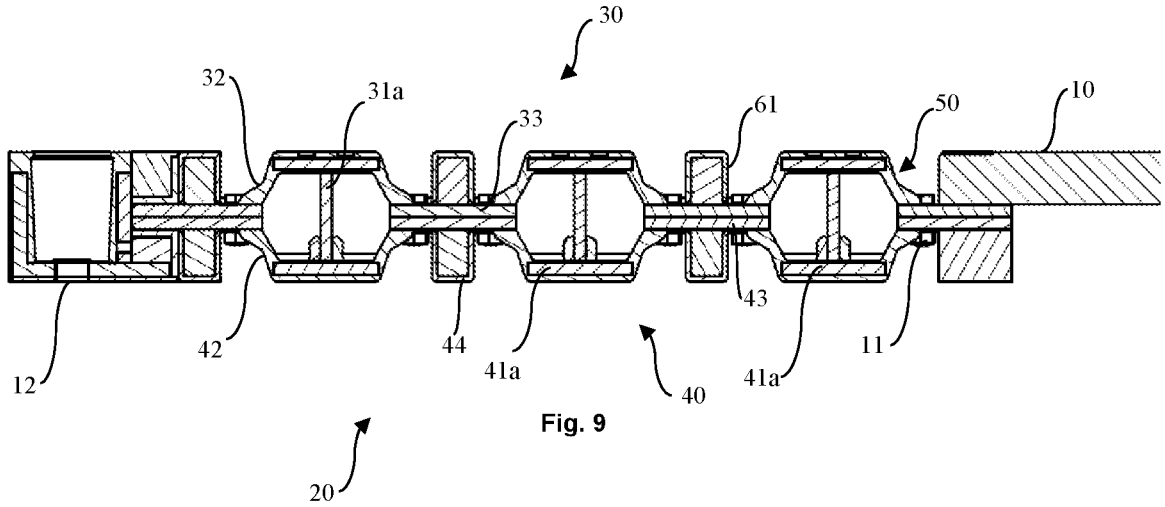
FIG. 9 represents a detail in section of the coupling between the upper portion and the lower portion of the deformable body of an expansion joint according to the present disclosure.

With particular reference to FIG. 9, according to an aspect of the present disclosure, the T-shaped elements 31*a*, in particular the horizontal portion of these elements, are placed at a first plane, or upper plane which coincides with the plane of the structural elements between which the expansion joint 1 is able to be installed. In other words, in the case of a joint for structures such as bridges or viaducts, the horizontal portion of the T-shaped elements 31*a* is placed at the road surface.

Moreover, the coupling elements 41*a* to said T-shaped elements 31*a* are placed at a second plane, or lower plane with respect to that of the structural elements between which the joint 1 is installed. In the case of a road junction, this plane is placed below the road surface. In fact, as mentioned above, the coupling elements 41*a* and said T-shaped elements are spaced apart. Finally, the first and second plate-like elements, respectively 31, 41, are placed at a plane interposed between said first floor, or upper floor, and said second floor, or lower floor. Furthermore, said three planes are parallel planes. This configuration allows the maximum excursion between the various elements that make up the at least one deformable body of the expansion joint 1.

Preferably, as can be seen from the figures, the expansion joint 1 according to the present disclosure comprises two deformable bodies, respectively 20*a* and 20*b* placed in the longitudinal direction at the ends of the plate body 10 so as to connect both the structural elements to the plate body 10 and to allow the free expansion of both said structural elements. In other words, therefore, according to a preferred embodiment, the expansion joint 1 according to the present disclosure preferably comprises two deformable bodies 20*a* and 20*b*, between which a plate body 10 is interposed. In this case, the first structural element, one of the two deformable elements, the plate body 10, the other deformable body, the second structural element form in this order a flanking or a sequence of elements in the longitudinal direction. The two deformable elements are preferably identical to each other, and connected to the adjacent elements in juxtaposition with the same modalities.

For example, the connection between the plate body 10 and said at least one deformable body 20 takes place through first connection means 11, such as for example screws, or other connection means known to the person skilled in the art.

The deformable body 20 is also connected to a structural element of the structure on which the joint is able to be installed by means of second connection means (not shown in the figures), such as for example metal anchor bolts. Specifically, the at least one deformable body 20 comprises a portion suitable for connection to a structural element on which the joint is placed. In particular, the at least one deformable body can comprise a hooking element 12, preferably metal, preferably hollow and filled with elastic material, on which a second connecting means is inserted, which is suitable for connecting this hooking element 12 to said structural element.

The hooking element 12 is preferably an element distinct from the at least one deformable body 20. The connection between said hooking element 12 and a deformable body 20 can take place through connection means such as screws, or other connection means known to the expert technician. of the branch.

Figure 3:
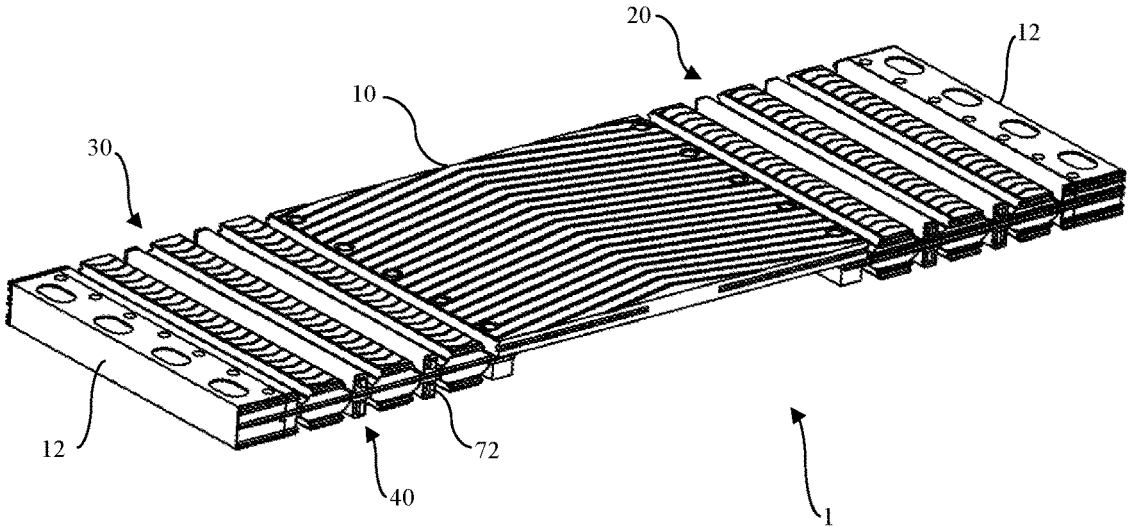
FIG. 3 shows a perspective view of an expansion joint according to the present disclosure in which female portions of interlocking elements are visible.
Figure 4:
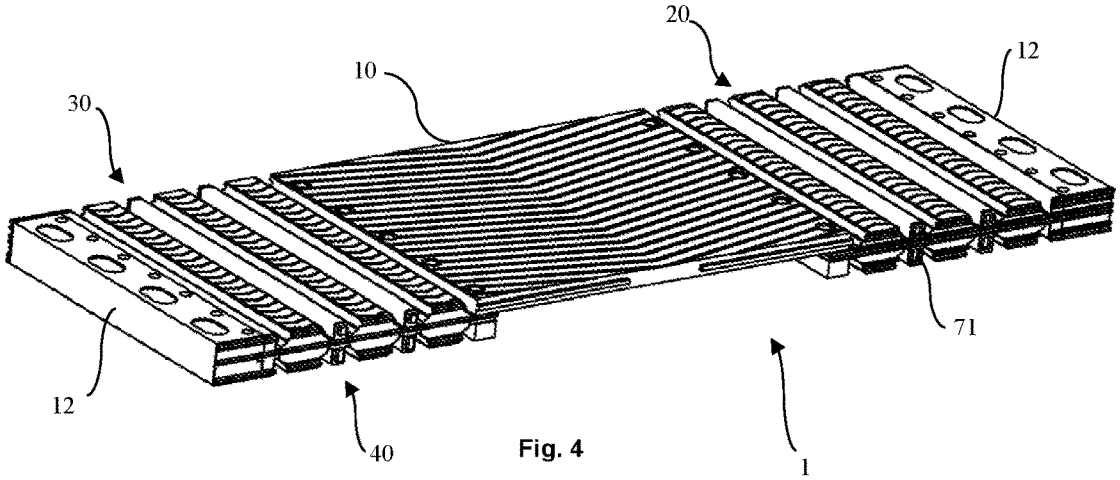
FIG. 4 shows a perspective view of an expansion joint according to the present disclosure in which male portions of interlocking elements are visible.
Figure 5:
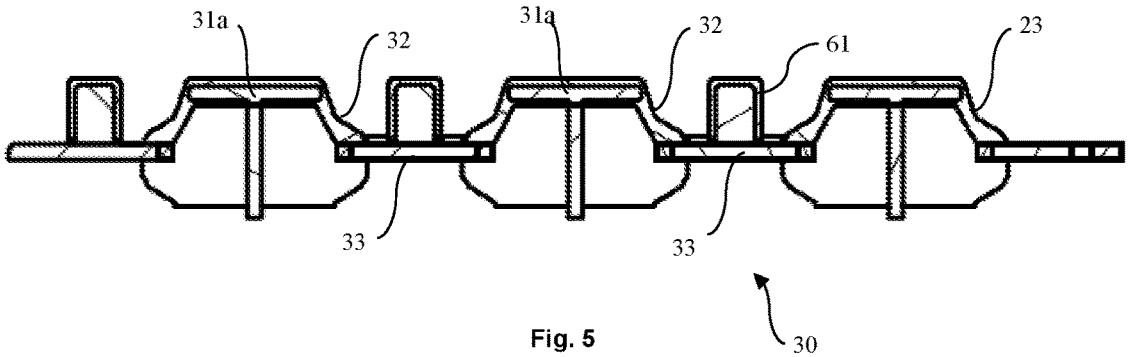
FIG. 5 shows a section view of an upper portion of the deformable body of an expansion joint according to the present disclosure.

With specific reference to FIGS. 3 and 4, according to a further aspect of the present disclosure, the expansion joint 1 furthermore comprising interlocking profiles 70 suitable for connecting said expansion joint 1 to other expansion joints in a transversal direction. In other words, the union of several expansion joints 1 according to the present disclosure can form a modular structure suitable for assuming variable dimensions so as to be able to connect structures of different sizes together. In other words, this solution allows to obtain an expansion joint of variable size depending on the dimensions of the structural elements to be connected.

In particular, according to one embodiment, the two ends of the expansion joint 1 in the transversal direction respectively comprise female portions 71 and male portions 72 of interlocking profiles 70. Specifically, a first side wall of the plate body 10 is not connected to deformable elements 20 or to one of the structural elements on which the joint 1 is able to be installed can comprise male portions 72 of interlocking profiles 70, and a second side wall of the plate body 10 not connected to deformable elements 20 or one of the structural elements on which the joint 1 is able to be installed can comprise female portions 71 of interlocking profiles 70. In the same way, male portions 72 and female portions 71 of interlocking profiles 70 can be placed at the ends of the hooking elements 12, of the T-shaped elements 31*a*, of the coupling elements 41*a*, of the first and second elements plate 33, 43 and of the interlocking elements 60. Specifically, FIG. 3 shows the side of the expansion joint 1 in which the male portions 72 of the interlocking profiles 70 are present, while FIG. 4 shows the female portions 71 of such interlocking profiles 70.

Figure 10:
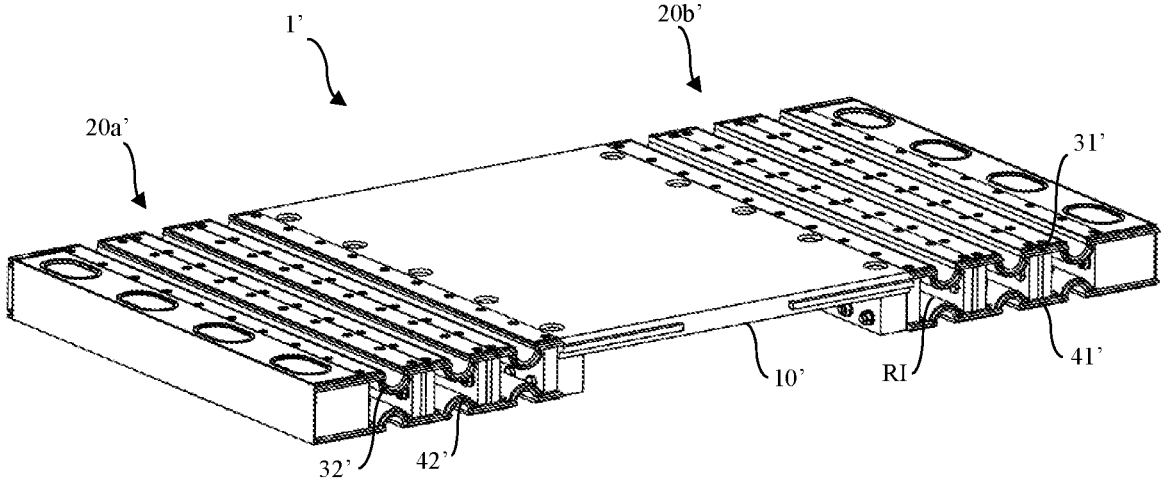
FIG. 10 is a perspective view of a second embodiment of an expansion joint according to the present disclosure.
Figure 11:
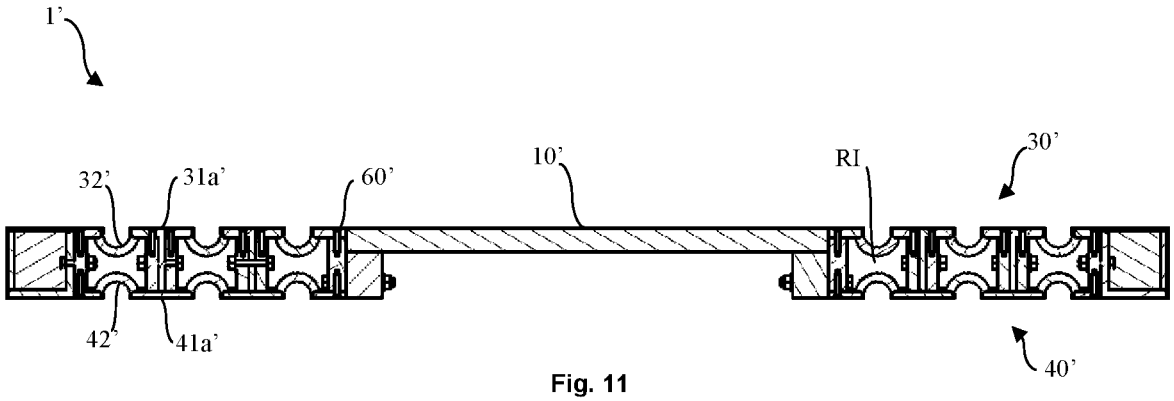
FIG. 11 shows a section view of a second embodiment of an expansion joint according to the present disclosure.

According to the embodiment shown in FIGS. 10 and 11, the expansion joint 1' comprises a plate body 10' and at least one deformable body 20' able to connect the plate body 10' in a longitudinal direction with a structural element of the structure on which the joint 1' is able to be installed. Preferably, the expansion joint 1' comprises two deformable bodies 20', respectively 20*a*' and 20*b*', placed in the longitudinal direction at the ends of the plate body 10.

The at least one deformable body 20' comprises two superimposed and structurally independent and separable portions. In particular, these superimposed portions comprise an upper portion 30' and a lower portion 40' which can be removably connected, preferably by fastening means 60' such as, for example, screws and bolts placed between the upper portion 30' and the lower portion 40' and/or removable joint means. The upper portion 30' and the lower portion 40' each comprise a plurality of substantially flat supporting portions for the vehicles that pass on the road surface and/or support portions of the joint 1' to an underlying structure. Between the support portions of the upper portion 30' and the support portions of the lower portion 40' are included elastic parts which allow a sort of springing of the entire joint. In other words, said elastic parts allow expansion of the joint due, for example, to changes in the ambient temperature or to seismic events. According to this embodiment, moreover, said elastic parts are arranged in, or facing towards, an inner region RI of the expansion joint 1', that is, a region interposed, in use, between said upper portion 30' and said lower portion 40'. Preferably, said first elastic portions 32' and second elastic portions 42' are arranged to define a groove or depression with respect to a visible surface of the expansion joint. In other words, said first elastic portions 32' and second elastic portions 42' are arranged so as not to protrude or face flush with the visible surface of the expansion joint. Each exposed surface preferably coincides with the respective upper and lower planes of the expansion joint. This reduces the risk of wear on the elastic portions.

More specifically, the upper portion 30' comprises a plurality of first transversal elements 31', that is to say elements with a main development direction perpendicular to the longitudinal direction of connection between the structural elements which the expansion joint 1' is adapted to connect. These first transversal elements 31' are arranged alongside in the longitudinal direction and connected together in the longitudinal direction by first elastic portions 32', or similar elements having a greater deformability than the first transversal elements 31'. The first elastic portions 32' faces, in use, towards said internal region RI of the expansion joint 1'. In other words, in use, the first elastic portions 32' do not face, in the case of a road expansion joint, towards the road surface. According to this aspect, said first elastic portions 32' do not come into contact with the tires of the vehicles passing over said expansion joint 1'. Consequently, the wear of the elastic portions 32' is reduced.

Similarly, the lower portion 40' comprises a plurality of second transversal elements 41', i.e. elements with a main development direction perpendicular to the longitudinal direction of connection between the structural elements which the joint 1' is able to connect. These second transversal elements 41' are arranged alongside in the longitudinal direction and connected to each other in the longitudinal direction by means of second elastic portions 42', or similar elements having a deformability greater than the second transversal elements 41'. The second elastic portions 42' face, in use, towards the internal region RI. According to this aspect, these second elastic portions 42' do not come into contact with the structure, in use, under the expansion joint 1'. Consequently, the wear of the elastic portions 42' is reduced. The number of said first and second transversal elements 31', 41' is variable according to the maximum excursion required by the structure on which the expansion joint 1 is suitable to be installed. Preferably, the number of said first transversal elements 31 'is equal to the number of said second transversal elements 42'.

According to an aspect of this embodiment, as shown in FIG. 11, the plurality of first transversal elements 31' of the upper portion 30' comprises T-shaped elements 31*a*'. Preferably, these T-shaped elements 31*a*' are connected together in the longitudinal direction by the first elastic portions 32'. According to this embodiment, the plurality of second transversal elements 41' of the lower portion 40' comprises coupling elements 41*a*' for a coupling with said T-shaped elements 31*a*'. Specifically, these coupling elements 41*a*' support said T-shaped elements 31*a*'. Preferably, moreover, said coupling elements 41*a*' are connected to each other in the longitudinal direction by the second elastic portions 42'. Alternatively, the plurality of second transversal elements 41' of the lower portion 40' comprises T-shaped elements connected together by the second elastic portions 42' and the plurality of first transversal elements 31' of the upper portion 30' comprises coupling elements for a coupling with the T-shaped elements connected by the first elastic portions 32'.

According to this second embodiment of the expansion joint 1', the plate body 10' can be inserted inside an elastic element. Preferably however, according to this embodiment, neither the plate body 10', nor the first and second transversal elements 31', 41' are inserted inside elastic elements.

The expansion joint 1', as described for the first embodiment, can comprise interlocking profiles suitable for connecting it with other expansion joints 1' in the transversal direction.

The present disclosure also relates to a building structure including the expansion joint described above. Preferably, this building structure is a road surface or a portion of road surface.

According to a further aspect of the present disclosure, thanks to the expansion joint 1, 1' described above, maintenance interventions due to damage caused for example by wear are considerably facilitated. Specifically, as stated, the expansion joint 1, 1' according to the present disclosure allows a simple replacement of the upper portion 30, 30' of the deformable body 20, 20', i.e. the portion most subject to wear. In particular, the method of repairing the expansion joint 1, 1' provides the following steps:

remove the upper portion 30, 30' from the lower portion 40, 40';

connect a new upper portion 30, 30' to the lower portion 40, 40'.

The new upper portion may be an upper portion different from the previous upper portion or may be the previous upper portion after repair or maintenance.

The object of the present disclosure has been so far described with reference to its embodiments. It is to be understood that there may be other embodiments which refer to the same inventive core, all falling within the scope of protection of the claims set forth below.

The invention claimed is:

1. An expansion joint for connecting structural elements of a building structure, wherein said expansion joint is adapted to a connection with one of said structural elements in a longitudinal direction, and wherein said expansion joint comprises a plate body, and a deformable body flanked or adjacent to said plate body along said longitudinal direction, wherein the deformable body includes a first portion and a second portion superimposed and structurally independent on each other, said superimposed first portion and second portion being connected one with the other in a removable way, and wherein said first portion is an upper portion comprising a plurality of first transversal elements connected with each other by first elastic portions; and wherein said second portion is a lower portion comprising a plurality of second transversal elements connected with each other by second elastic portions, said first transversal elements and said second transversal elements being elements which extend in a direction transverse to the longitudinal direction.

2. The expansion joint according to claim 1, wherein the first transversal elements of said first portion are arranged side by side in said longitudinal direction and the second transversal elements of said second portion are arranged side by side in said longitudinal direction.

3. The expansion joint according to claim 1, wherein said plurality of first transversal elements of the upper portion comprises T-shaped elements and said plurality of second transversal elements of the lower portion comprises coupling elements for a coupling with said T-shaped elements or wherein said plurality of second transversal elements of the lower portion comprises T-shaped elements and said plurality of first transversal elements of the upper portion comprises coupling elements for a coupling with said T-shaped elements.

4. The expansion joint according to claim 1, wherein said first elastic portions and second elastic portions are arranged in an internal region (RI) interposed between said upper portion and said lower portion, and wherein said first elastic portions and second elastic portions are arranged so as not to protrude or to be flush-faced on a visible surface of the expansion joint or on a visible surface of the respective first and second portion.

5. The expansion joint according to claim 1, wherein said plate-like element is inserted inside an elastic element.

6. The expansion joint according to claim 1, further comprising interlocking profiles suitable for connecting said expansion joint to other expansion joints in the transversal direction.

7. The expansion joint according to claim 1, wherein said first portion and second portion can be connected together by means of removable interlocking elements and/or fastening means.

8. The expansion joint according to claim 1, wherein each of the first transversal elements defines with a respective second transversal element with which it is coupled a ring structure or configuration.

9. The expansion joint according to claim 8, wherein each of said first portion and second portion comprises mutual contact elements and each ring structure is connected to an adjacent ring structure through the mutual contact elements.

10. The expansion joint according to claim 8, wherein said plurality of first transversal elements or said plurality of second transversal elements are metal elements inserted inside elastic elements.

11. The expansion joint according to claim 8, wherein the T-shaped elements alternate in the longitudinal direction with first plate-like elements and wherein the coupling elements for a coupling with said T-shaped elements alternate in the longitudinal direction with second plate-like elements.

12. The expansion joint according to claim 11, wherein said mutual contact elements comprise one of said first plate-like elements and one of said second plate-like elements.

13. The expansion joint according to claim 11, wherein said second plate-like elements comprise supporting elements extending in a direction perpendicular to said longitudinal and transverse directions and adapted to provide structural support to the upper portion.

14. The expansion joint according to claim 11, wherein said T-shaped elements are arranged at a first plane or upper plane, said coupling elements are arranged at a second plane or lower plane, and said first and second plate-like elements are arranged at a plane interposed between said first plane or upper plane, and said second plane, or lower plane.

15. The expansion joint Ea according to claim 11, wherein the ring structure comprises one of said T-shaped elements, one of said coupling elements and one couple of elastic elements.

16. The expansion joint according to claim 11, wherein one among said first plate-like elements and said second plate-like elements comprises a female portion of interlocking elements and the other one among said first plate-like elements and said second plate-like elements comprises a male portion of interlocking elements.

17. The expansion joint according to claim 12, wherein said coupling elements comprise a coupling seat for said T-shaped elements.

18. A building structure including an expansion joint according to claim 1.

19. The building structure according to claim 18, wherein said building structure is a road surface, or a portion of road surface.

20. A method for repairing an expansion joint of claim 1, said repair method comprising the steps of:

removing a connection of the upper portion from the lower portion; and connecting a new upper portion to the lower portion.

21. The method for repairing an expansion joint according to claim 20, wherein said method is performed on an expansion joint.

* * * * *